US009850719B1

(12) United States Patent
Ferrier et al.

(10) Patent No.: US 9,850,719 B1
(45) Date of Patent: Dec. 26, 2017

(54) PRODUCTION RISERS HAVING RIGID INSERTS AND SYSTEMS AND METHODS FOR USING

(71) Applicant: Chevron U.S.A. Inc., San Ramon, CA (US)

(72) Inventors: Brian Ferrier, Houston, TX (US); Alireza Mazaheri, Cottesloe (AU)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 15/495,012

(22) Filed: Apr. 24, 2017

(51) Int. Cl.
*E21B 17/01* (2006.01)
*E21B 17/12* (2006.01)
*E21B 17/10* (2006.01)

(52) U.S. Cl.
CPC ..... *E21B 17/01* (2013.01); *E21B 17/1007* (2013.01); *E21B 17/12* (2013.01)

(58) Field of Classification Search
CPC ..... E21B 17/01; E21B 17/1007; E21B 17/12
See application file for complete search history.

(56) References Cited

U.S. PATENT DOCUMENTS 3,277,969 A * 10/1966 Vincent ..... E21B 7/12 166/113
3,459,270 A * 8/1969 Schuh ..... E21B 7/128 166/75.11
4,794,988 A * 1/1989 van Bilderbeek .... E21B 33/043 166/345
5,497,807 A * 3/1996 Rogers ..... F16L 55/1645 138/97
5,524,710 A * 6/1996 Shinn ..... E21B 19/006 166/348
6,253,855 B1 * 7/2001 Johal ..... E21B 17/01 166/345
6,302,201 B1 * 10/2001 Elliott ..... E21B 17/1007 15/104.05
6,431,285 B2 * 8/2002 Hopper ..... E21B 7/043 166/368
7,699,109 B2 * 4/2010 May ..... E21B 17/01 166/339
8,201,622 B2 * 6/2012 Reid ..... E21B 17/1007 166/208
8,297,359 B2 * 10/2012 McKay ..... E21B 33/035 166/339

(Continued)

*Primary Examiner* — Matthew R Buck
(74) *Attorney, Agent, or Firm* — Karen R. DiDomenicis

(57) ABSTRACT

An apparatus enables modifying a riser's operating parameters for transporting production fluids from a subsea well to an offshore production facility after an initial period of production to address changes over time in the conditions of the reservoir and/or the riser without removing the original riser. An insert riser having a smaller diameter is inserted into the riser after the initial period. The original riser has a recessed seal face for receiving seal element(s) and a recessed lock groove for receiving a locking ring. An intervention coiled tubing having a sleeve removal tool is inserted into the riser to engage a protective sleeve covering the recessed seal face. The tubing is pulled to the floating structure thereby removing the protective sleeve and the temporary retaining ring from the production riser, exposing the recessed seal face. The insert riser can then be inserted into the riser and locked into place.

17 Claims, 11 Drawing Sheets

(56) References Cited

U.S. PATENT DOCUMENTS

| | | | | |
|---|---|---|---|---|
| 8,950,498 | B2 * | 2/2015 | Parsinejad | F17D 1/08 166/344 |
| 8,950,499 | B2 * | 2/2015 | Critsinelis | E21B 17/01 166/344 |
| 9,376,870 | B2 * | 6/2016 | Orbell | E21B 17/085 |
| 9,605,490 | B2 * | 3/2017 | Hess | E21B 33/038 |
| 9,631,438 | B2 * | 4/2017 | McKay | E21B 33/035 |
| 2016/0047183 | A1 * | 2/2016 | Jekot | E21B 17/1007 166/379 |

* cited by examiner

PRODUCTION RISERS HAVING RIGID INSERTS AND SYSTEMS AND METHODS FOR USING

FIELD

The disclosure relates generally to methods and systems for operating a production riser in an offshore hydrocarbon production facility. More particularly, the disclosure relates to methods and systems for enabling modifications to the riser after an initial period of production.

BACKGROUND

Production risers, also known as marine risers and subsea risers, are used in offshore hydrocarbon production facilities to convey produced fluids including hydrocarbons from a subsea well to a topsides production platform or vessel. Production risers are designed and sized to meet specific mechanical requirements, e.g., fatigue life, taking into account anticipated field conditions including flow regime, fluid velocity, pressure, temperature and fluid chemistry. Excessive riser fatigue can lead to reduction in the life-span of the riser and riser replacement.

Design requirements for production risers change over the life of an oil and gas field, as produced fluid composition and flow regimes change. For one thing, over the life of the field, fluid velocities in a production riser decrease as flow of production fluids from a well diminishes over time. Pressure and temperature profiles of the produced fluids can change over time. Additionally, the need for corrosion resistance of the production riser may increase as a reservoir sours over time. The brownfield tie-in of other reservoirs having increased level of sour gas, i.e. carbon dioxide and hydrogen sulfide, can also increase the corrosivity of the production fluids seen by the production riser. As a result of corrosive or erosive fluids flowing through a riser, the riser may experience a reduction in wall thickness to the point that its mechanical properties are affected and it must be replaced. The need for gas lift in the production riser may increase. In certain instances, the optimum riser design parameters, e.g., internal diameter and selected material to meet the requirements for late life operations can be significantly different from the parameters required for early life operations. In such instances, a production riser may be required to be replaced during the life of the field.

The most common solution is to replace the production riser with a riser having a different diameter and/or different metallurgy. Such riser replacement programs require offshore installation or pipelay vessels, resulting in high capital and/or operating expense. The riser design, procurement and installation process is generally time-consuming, taking up to 24 months, depending on factors such as the degree of remoteness of the production facility, water depth, pressure, fluid composition and flowrate. Some facilities include additional riser slots to allow for the installation of a different riser once the initial production riser becomes unsuitable for use, resulting in additional capital expense.

It would be desirable to avoid having to replace a production riser during the life of a field.

SUMMARY

In one aspect, an apparatus is provided for facilitating a change in diameter of a riser for transporting production fluids from a subsea well to a production facility on a floating structure after an initial period of production. The apparatus includes a production riser having a topsides end for attaching to a riser hanger assembly on the floating structure, a subsea end for supporting on a pipeline end termination structure located on a seabed and attaching to a subsea pipeline, an outer production riser surface and an inner production riser surface. The inner production riser surface has a polished recessed seal face proximate the subsea end for receiving one or more seal elements and a recessed lock groove proximate the polished recessed seal face for receiving a locking ring. A protective sleeve proximate the subsea end covers the polished recessed seal face. The protective sleeve has an outer sleeve surface for partially engaging the inner production riser surface and an inner sleeve surface comprising a groove therein for receiving a sleeve removal tool. A temporary retaining ring is provided in the recessed lock groove in the inner production riser surface for holding the protective sleeve in place during the initial period of production.

In another aspect, a production riser system is provided for facilitating change in diameter of a riser for transporting production fluids from a subsea well to a production facility on a floating structure after an initial period of production. The production riser system includes a pipeline end termination (PLET) structure located on a seabed a distance along the seabed from the floating structure. The system includes the apparatus described above wherein the subsea end of the production riser is mounted on the pipeline end termination structure and the topsides end of the production riser is attached to the riser hanger assembly on the floating structure.

In another aspect, a method is provided for changing diameter of a riser for transporting production fluids from a subsea well to a production facility on a floating structure after an initial period of production. At a desired time after the initial period of production, intervention coiled tubing is inserted into the production riser of the above-described apparatus from the floating structure. The intervention coiled tubing has a sleeve removal tool at a distal end thereof. The groove of the inner sleeve surface of the protective sleeve is engaged with the sleeve removal tool. The intervention coiled tubing is pulled to the floating structure thereby removing the protective sleeve and the temporary retaining ring from the production riser and exposing the polished recessed seal face.

BRIEF DESCRIPTION OF THE DRAWINGS

These and other objects, features and advantages of the present invention will become better understood with reference to the following description, appended claims and accompanying drawings. The drawings are not considered limiting of the scope of the appended claims. The elements shown in the drawings are not necessarily to scale. Reference numerals designate like or corresponding, but not necessarily identical, elements.

DETAILED DESCRIPTION

Figure 1:
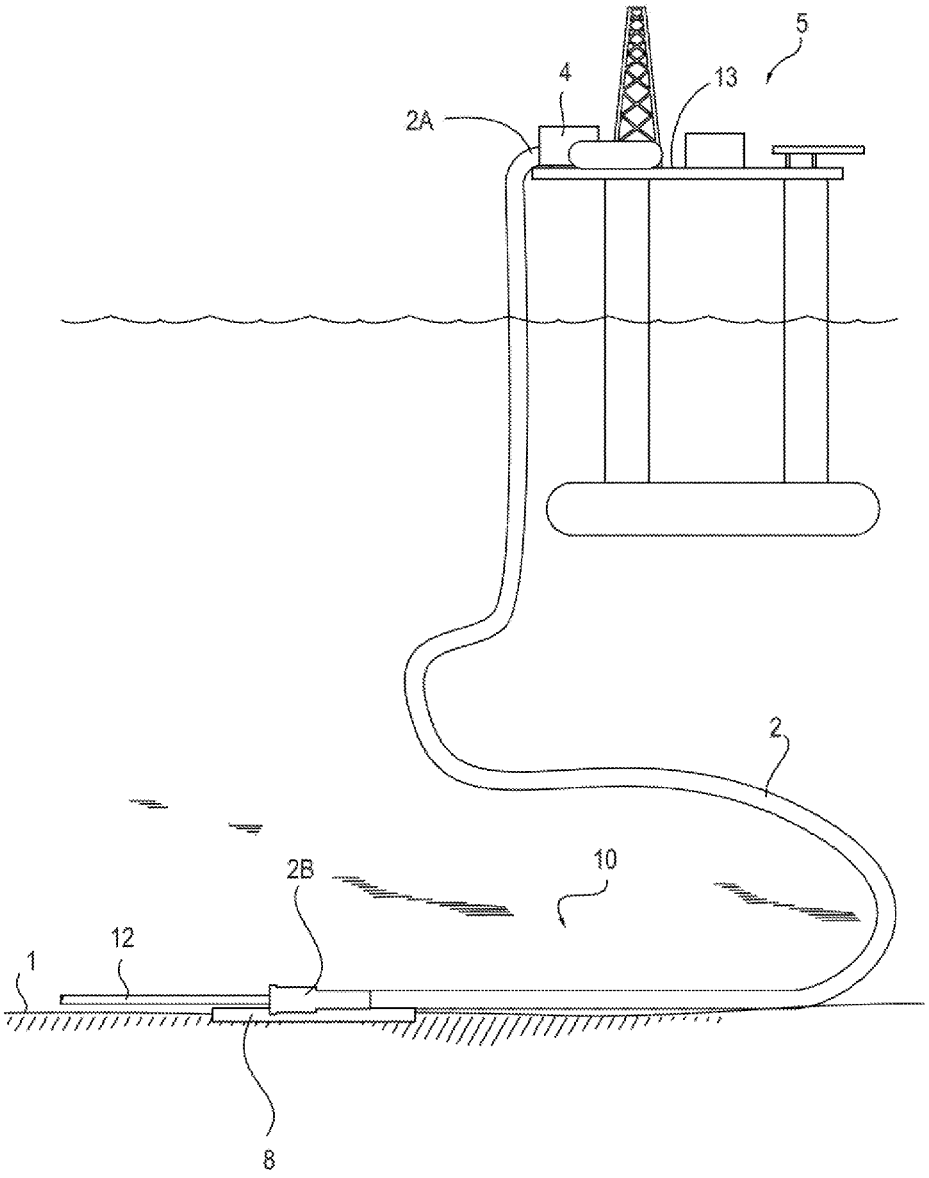
FIG. 1 is a simplified view of a riser apparatus according to one embodiment.

An apparatus is provided for facilitating a change in diameter of a riser for transporting production fluids from a subsea well to a production facility on a floating structure after an initial period of production will now be described. As shown in FIG. 1, in one embodiment, the apparatus 10 includes a production riser 2, also referred to herein as a riser 2, having a topsides end 2A. The riser 2 can be attached at the topsides end 2A to a riser hanger assembly 4, also referred to herein as a riser hang off assembly 4, located on the deck 13 of the floating structure 5, through which the riser 2 passes. The riser hang off assembly 4 is a toroidal object having a load shoulder providing a point for the riser 2 to hang from. The top of the riser 2A has a shoulder which rests on the hang off assembly 4. Above the riser hanger assembly 4, a closing spool (not shown), also referred to as a connection spool, makes the final (or closing) connection between the topsides end 2A of the riser 2 and the permanent pipework (not show) of the topside production facilities on the floating structure 5.

In one embodiment, the production riser 2 of the apparatus 10 includes has a subsea end and a section proximate the subsea end also referred to as the end section or the riser base 2B. The riser base 2B can be supported on a pipeline end termination (PLET) structure 8 on a seabed 1. At the PLET 8, the subsea end 2B of the riser 2 can be attached to a subsea flowline 12 for transporting produced reservoir fluids including oil, gas and/or water. The riser 2 can be installed by any suitable installation means, e.g. using an offshore construction pipelay vessel (not shown). In one embodiment, the riser base 2B supported on the PLET 8 has a thicker wall than the riser 2. Whereas the thickness of the riser 2 can be typically 1-2 inches, the thickness of the end section 28 can be typically 2-4 inches. The length of the end section 28 can be from about 2 feet to about 6 feet.

Figure 2:
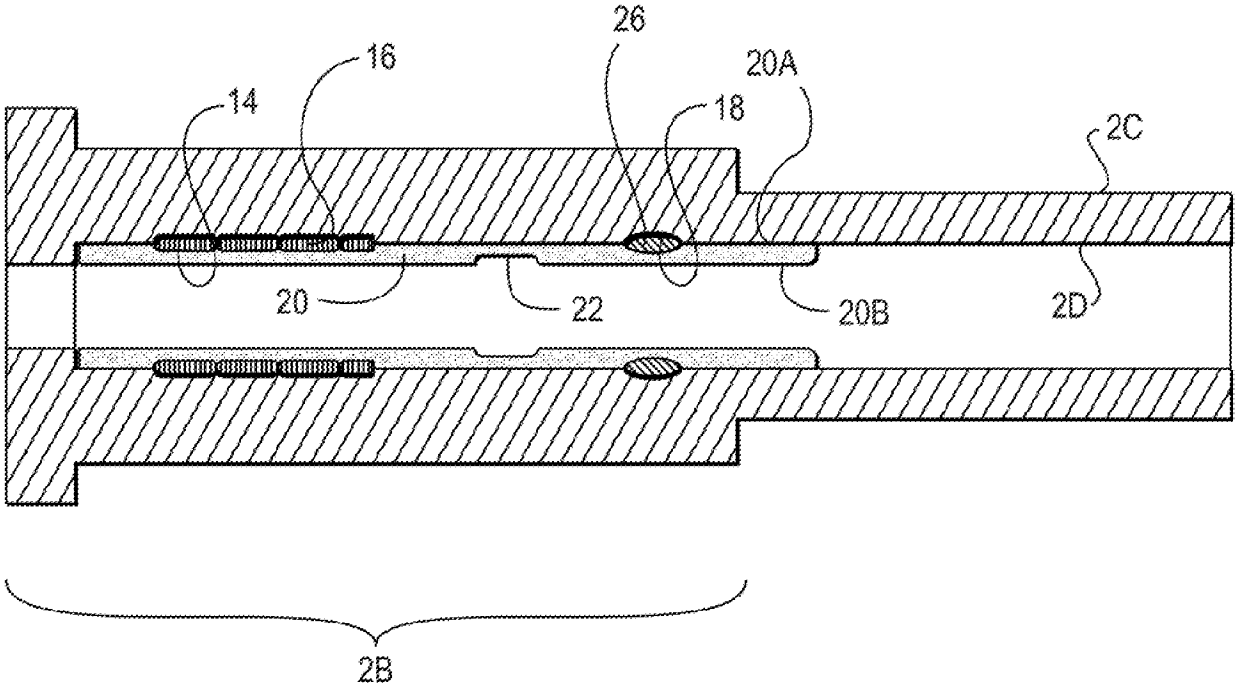
FIG. 2 is a simplified view of a subsea end of a riser with a protective sleeve according to one embodiment.

FIG. 2 shows the subsea end 2B in more detail. As shown in FIG. 2, in one embodiment, the riser 2 has an outer production riser surface 2C and an inner production riser surface 2D. In one embodiment, the inner production riser surface 2D includes a recessed seal face 14 in the end section near or proximate the subsea end 2B. The seal face 14, also referred to as the seal receptacle 14, receives temporary seal elements 16 also referred to as seal elements or seal assemblies. The seal elements 16 can be gaskets, O-rings or the like. The seal face 14 can be incorporated during the manufacture of the riser 2. The seal face 14 is recessed so that it may receive one or more seal elements 16. The seal face 14 is polished so that it will provide a reliable seal when the insert riser 30 (to be described hereinafter) is installed, thus sealing off the annular space, also referred to herein as the annulus, created between the production riser 2 and the insert riser 30. A recessed lock groove 18 is located near or proximate the recessed seal face 14.

In one embodiment, the riser base 2B, i.e., the end section of the production riser 2 proximate the subsea end of the production riser 2, is equipped with a protective sleeve 20. The protective sleeve 20 covers the seal elements 16 to prevent erosion damage during early reservoir life production when the production riser 2 is used to transport produced fluids. The protective sleeve 20 can be retrieved via a wireline, also referred to as intervention coiled tubing or coiled tubing, from the floating production facility on the floating structure 5, e.g. from the riser porch.

A protective sleeve 20 is located near or proximate the subsea end 2B for covering the recessed seal face 14. The protective sleeve 20 can be installed during the manufacture of the production riser 2. The main function of the protective sleeve 20 is to protect the seal face 14. The protective sleeve 20 has an outer sleeve surface 20A for partially engaging the inner production riser surface 2D and an inner sleeve surface 20B. The inner sleeve surface 20B has a groove 22 therein. The groove 22 can receive a sleeve removal tool (described hereinafter). The protective sleeve 20 may have a tapered shape to facilitate pigging operations.

A temporary retaining ring 26, also referred to as a snap ring, which can be integral with the protective sleeve 20 locks into place in the recessed lock groove 18 to hold the protective sleeve 20 in place for a desired period of time. Alternatively, a shear pin mechanism (not shown) can be used to hold the protective sleeve 20 in place. In one embodiment, the protective sleeve 20 is held in place during the initial period of production.

In one embodiment, the protective sleeve 20 has a recessed shoulder profile, i.e., the groove 22, on the inside bore to facilitate retrieving the protective sleeve 20 from the riser 2. A mechanical running and retrieval tool (described hereinafter) can be deployed on coiled tubing to engage the recessed shoulder profile to retrieve the protective sleeve 20 from the riser 2.

Figure 3:
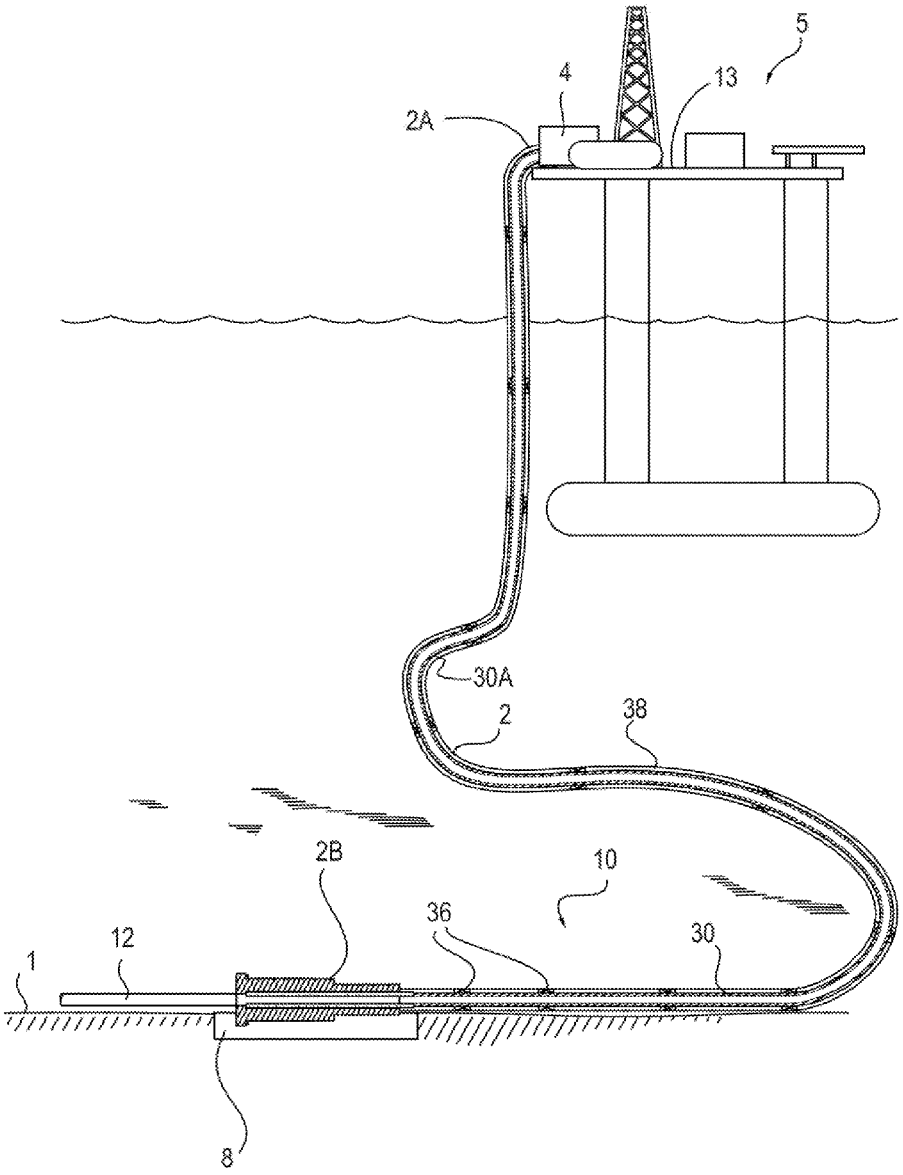
FIG. 3 is a simplified view of a riser apparatus with an insert riser inserted according to one embodiment.

In one embodiment, an insert riser 30 is inserted into the production riser 2 such that the apparatus 10 further includes the insert riser 30. The insert riser 30 can be a length of coiled tubing, steel pipe, or downline pipe made of any suitable material such as steel pipe, composite pipe and the like. FIG. 3 shows the system as illustrated in FIG. 1 in which the apparatus 10 further includes the insert riser 30.

Figure 4:
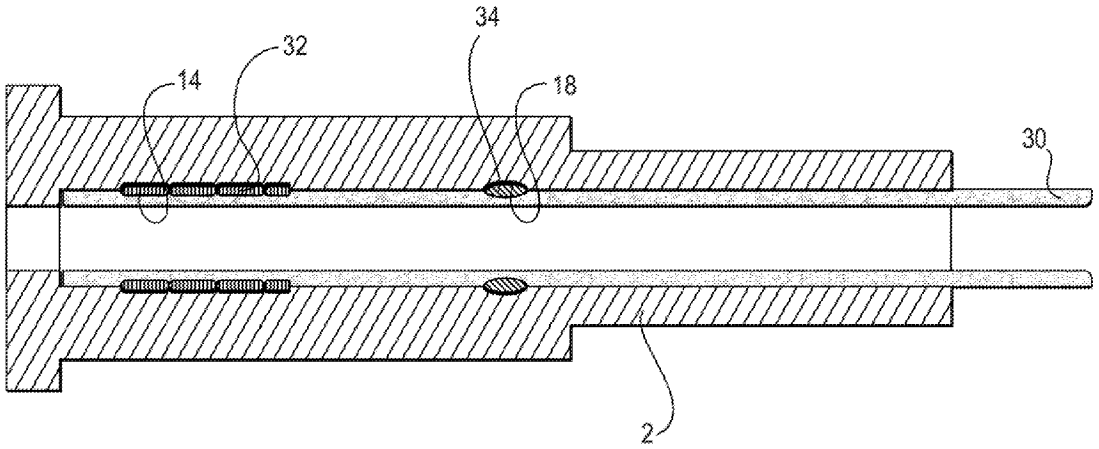
FIG. 4 is a simplified view of a subsea end of a riser with an insert riser inserted according to one embodiment.

In one embodiment, when the insert riser 30 is inserted into the production riser 2, an annulus 38 is formed between the outer surface 30A of the insert riser 30 and the inner surface 28 of the production riser 2. FIG. 4 shows the subsea end 2B with the insert riser 30 inserted in more detail. One or more seal elements 32 are provided around the outer surface 30A of the insert riser 30. The seal elements 32 are capable of engaging the recessed seal face 14 of the production riser 2. In one embodiment, a locking ring 34 is provided around the outer surface 30A of the insert riser 30. The locking ring 34 is capable of fitting into the recessed lock groove 18 of the production riser 2.

Referring to FIG. 3, in one embodiment, the insert riser 30 includes a plurality of centralizers 36 along the length of the insert riser 30 for centering the insert riser 30 within the production riser 2.

Figure 5:
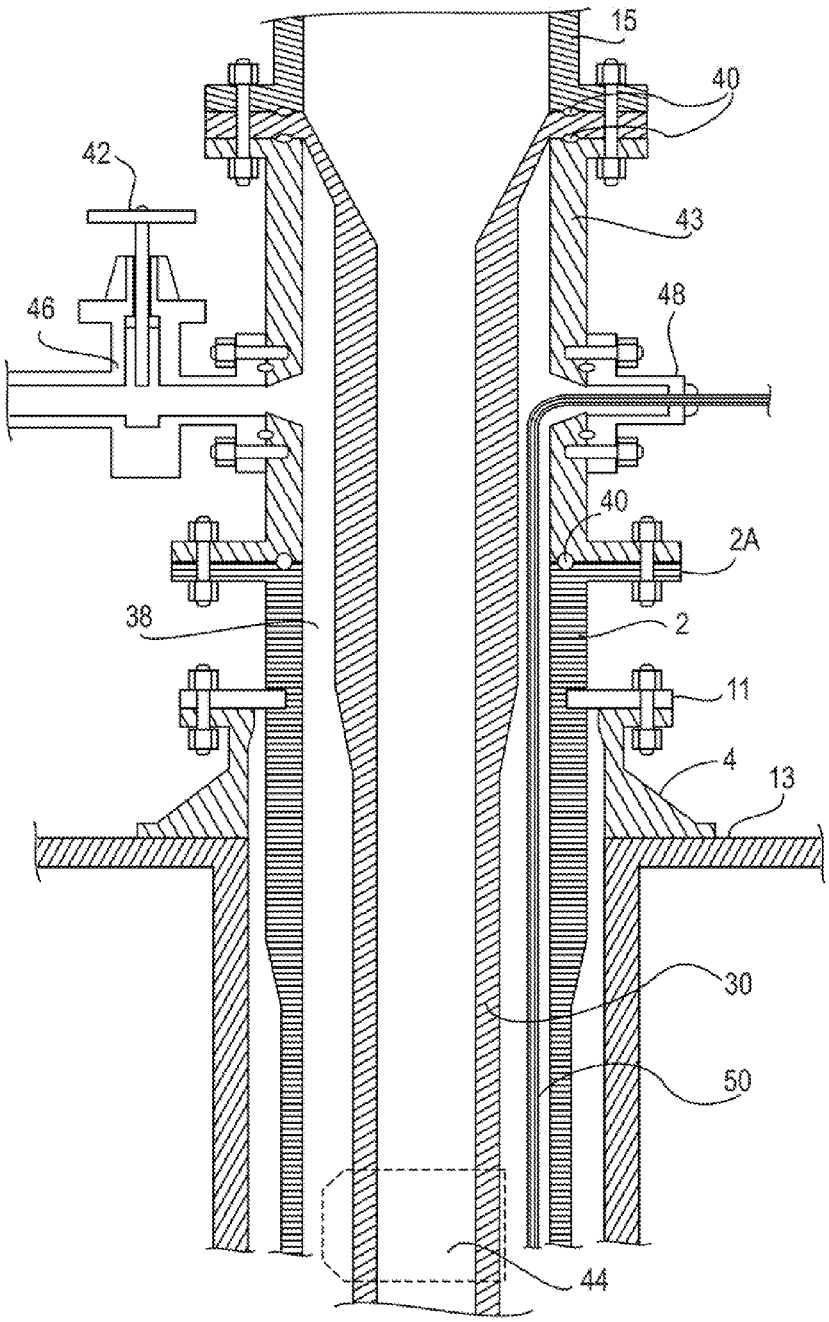
FIG. 5 is a simplified view of a riser supported by a hang off assembly on a floating structure according to one embodiment.

Referring to FIG. 5, riser 2 is supported above the deck 13 of the floating structure 5 by a hang off clamp 11 attached to a hang off assembly 4 on the deck 13. In one embodiment, the top end of the apparatus 10 includes a spool connection 43, also referred to herein as an insert riser hang off spool 43, located between the closing spool 15 and the riser 2, above the deck 13. The top end of the riser 2A attaches to the lower end of the spool connection 43. In one embodiment, the spool connection 43 has at least one inlet 46 therein for introducing gases into the annulus 38. The inlet 46 can have an injection check valve 42 in the inlet 46 for providing fluid flow between an external source (not shown) of gases on the floating structure and the annulus 38. The inlet 46 provides an access point at the riser hang off for controlling fluid types, levels and pressures within the annulus 38. In one embodiment, the spool connection 43 further seals off production from the annulus 38. Through the inlet 46, gas lift can be provided to the annulus 38 to assist with production in the insert riser 30 by way of an optional side pocket mandrel 44. In such case, a side pocket mandrel 44 can be located within the insert riser 30 at any desired location along the length thereof. The side pocket mandrel 44 can be a screwed pipe connection located at a predetermined point in the insert riser 30 with a check valve (not shown) installed in the mandrel pocket that allows gas to flow from the annulus 38 into the production bore within the insert riser 30 to lighten the column of fluid and increase flow of hydrocarbons.

In one embodiment, the apparatus 10 includes seal assemblies 40, also referred to as gaskets 40, to seal the annulus 38. Gaskets 40 can be located between the topsides end 2A of the production riser 2 and the insert riser hang off spool 43, between the insert riser 30 and the hang off spool 43, and between the insert riser hang off spool 43 and the closing spool 15.

In one embodiment, referring to FIG. 3, a production riser system is provided that includes the apparatus 10 as described above. The production riser 2 transports production fluids from a subsea well (not shown) to the production facility on the floating structure 5. The PLET structure 8 is located on the seabed 1 a distance along the seabed from the floating structure 5. The subsea end 2B of the production riser 2 is mounted on the PUT structure 8. The topsides end 2A of the production riser 2 is attached to the riser hanger assembly 4 on the floating structure 5.

Figure 6A:
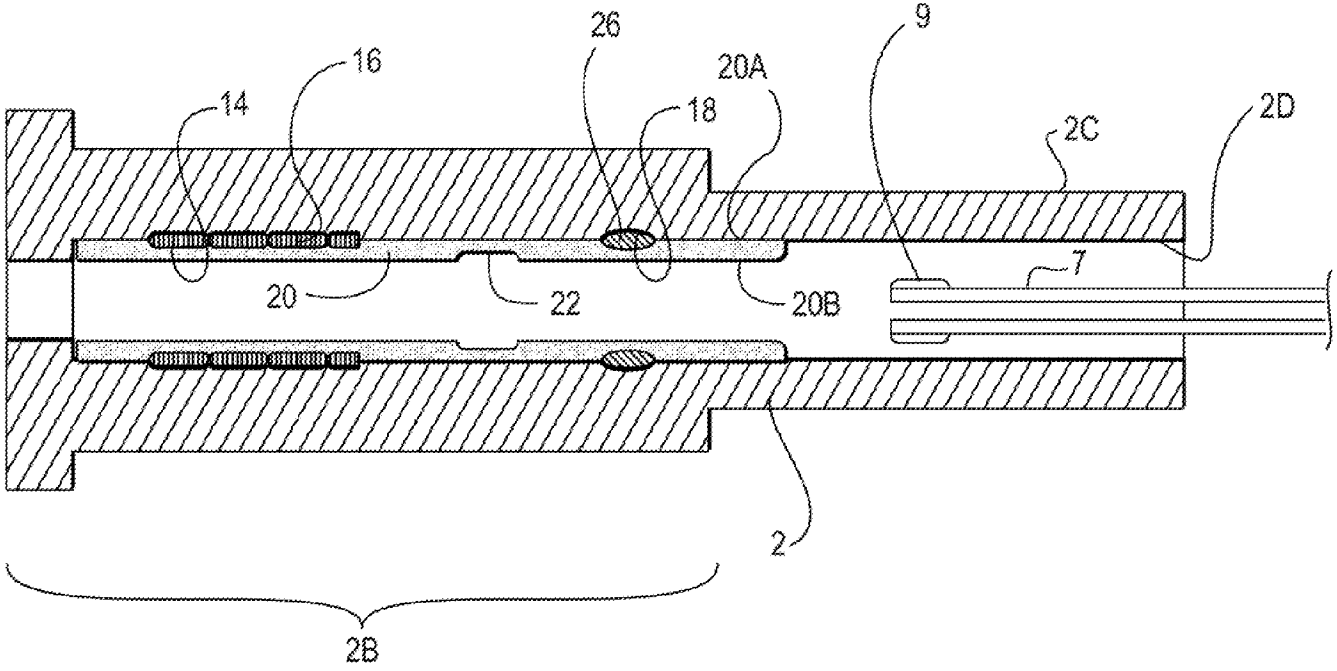
FIGS. 6A-6F are simplified views illustrating a method for changing diameter of a riser according to one embodiment.

In one embodiment, illustrated in FIGS. 6A-6F, a method is provided for changing a diameter of a riser for transporting production fluids from a subsea well to a production facility on a floating structure after an initial period of production. As shown in FIG. 6A, at a desired time after the initial period of production, tubing 7, e.g., intervention coiled tubing, is inserted into the production riser 2 of the apparatus 10 from the floating structure 5. The intervention coiled tubing 7 has a sleeve removal tool 9 at a distal end 7D thereof.

Figure 6B:
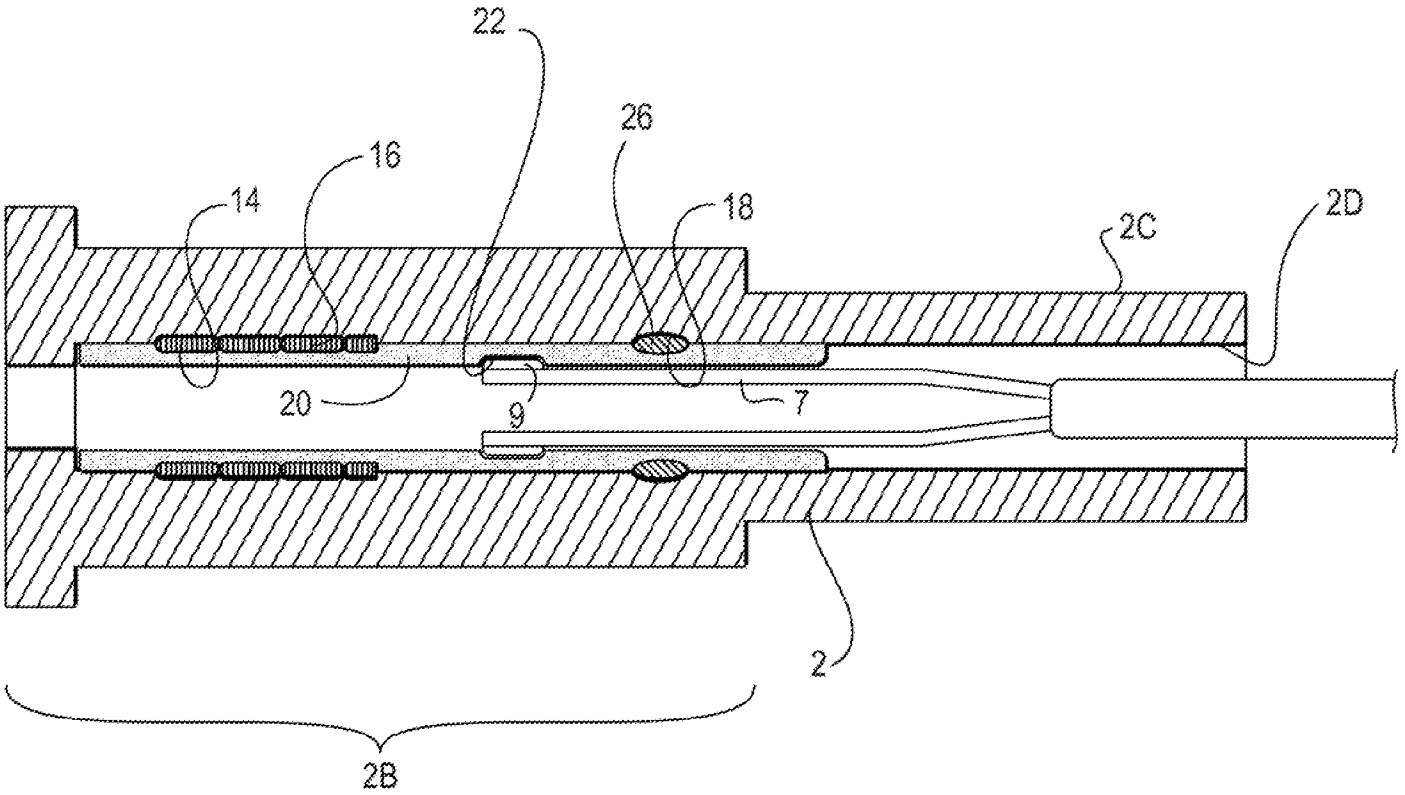
Figure 6C:
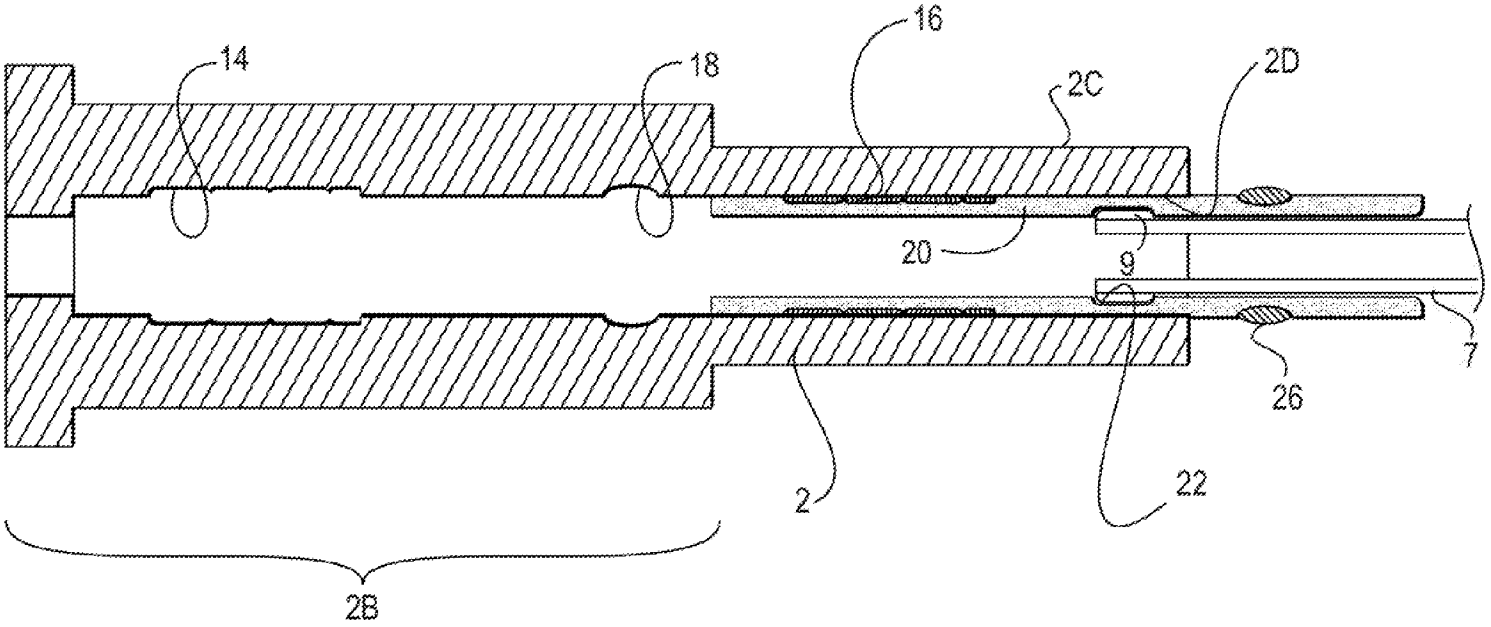
Figure 6D:
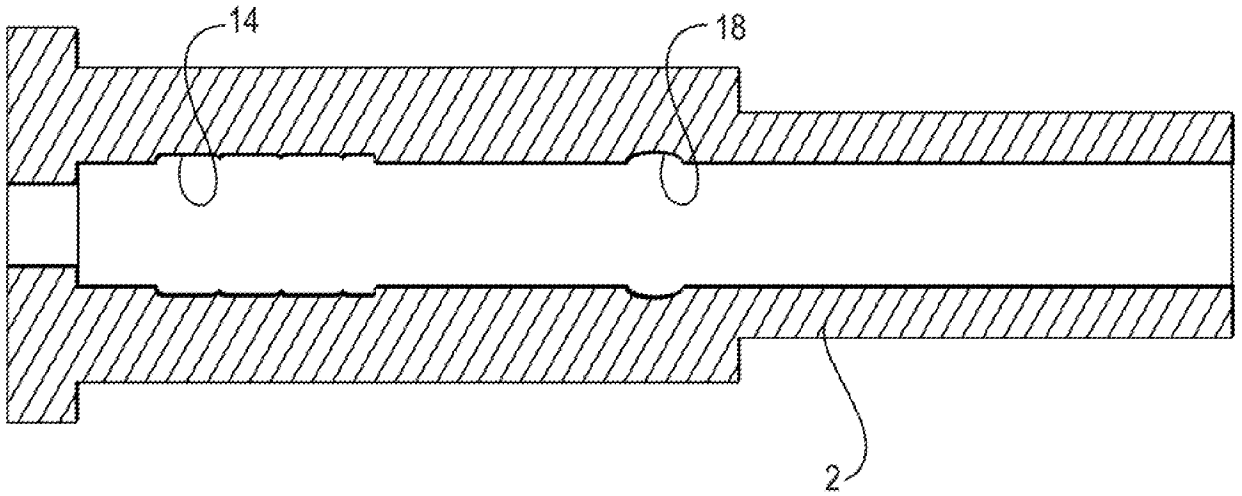

As shown in FIG. 6B, the groove 22 of the inner sleeve surface 20B of the protective sleeve 20 is engaged with the sleeve removal tool 9. As shown in FIG. 6C, the intervention coiled tubing 7 is pulled to the floating structure 5, thereby removing the protective sleeve 20 and the temporary retaining ring 26 from the production riser 2 and exposing the polished recessed seal face 14 as shown in FIG. 6D.

Figure 6E:
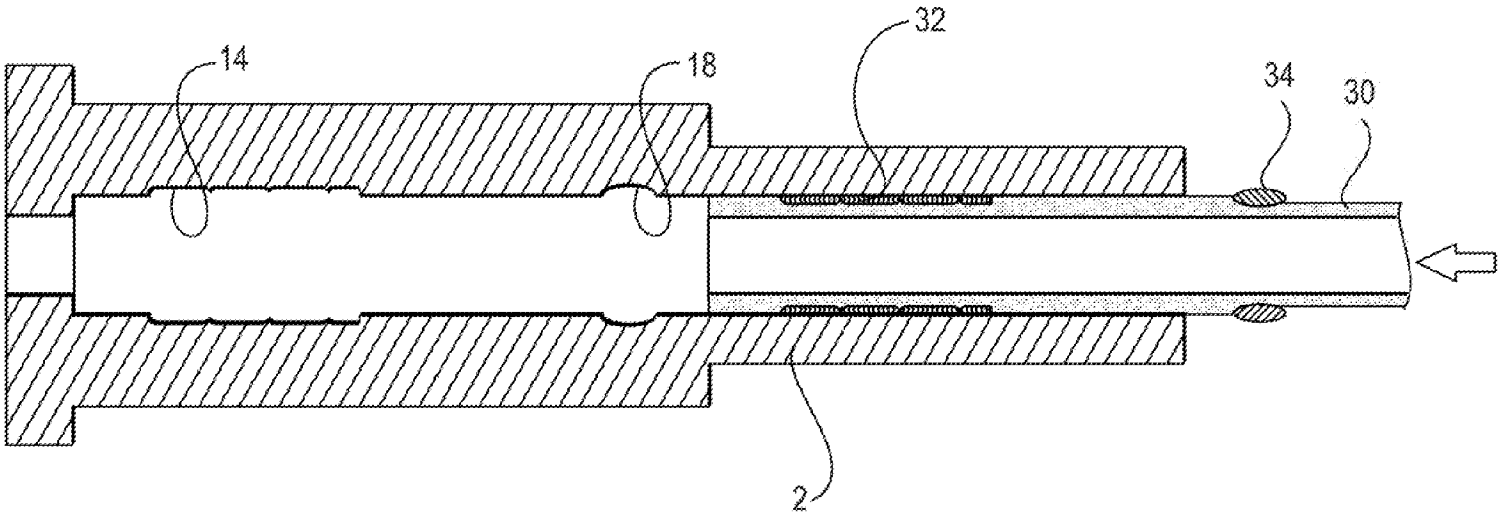
Figure 6F:
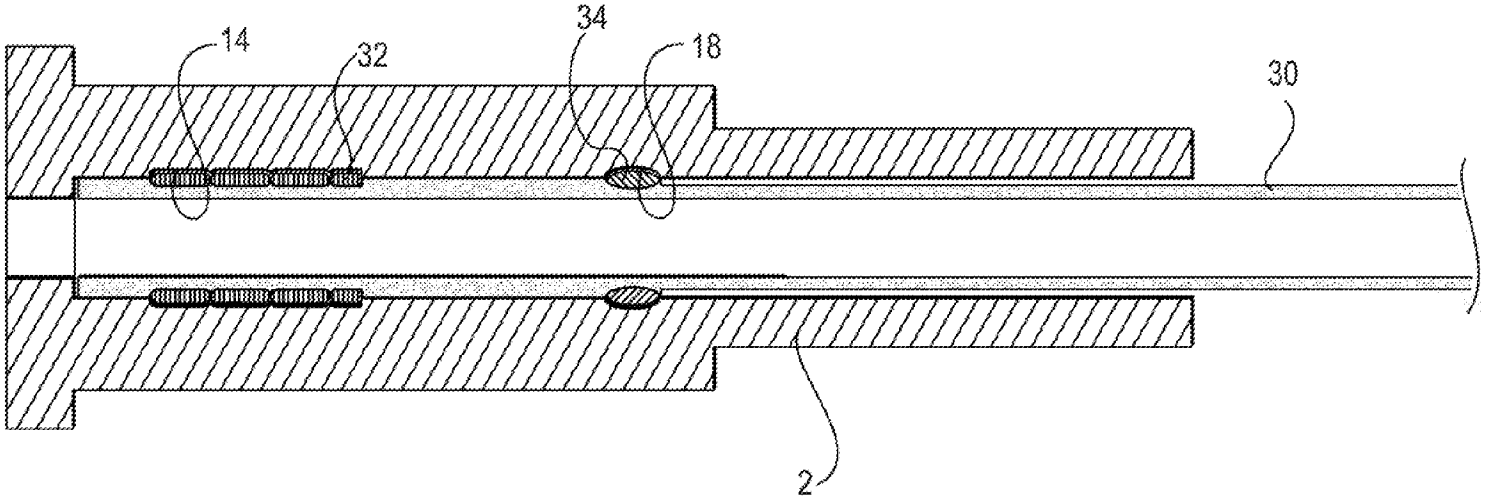

Once the protective sleeve 20 and temporary retaining ring 26 have been removed and the seal face 14 has been exposed, the insert riser 30 is inserted into the production riser 2 from the floating structure 5, as shown in FIG. 6E. The insert riser 30 can either be installed using coiled tubing for smaller diameter lines, or by joining together 30 foot sections of tubing on the main deck 13 of the floating structure 5 using a workover mast (not shown). The one or more seal elements 32 around the outer surface of the insert riser 30 engage the recessed seal face 14. The locking ring 34 around the outer surface of the insert riser 30 fits into the recessed lock groove 18, as shown in FIG. 6F.

In one embodiment, the top of the production riser 2 can be hung off the floating structure 5 in a riser hang off above a flex joint that includes a seal assembly to isolate the annulus 38 that is created by installing the insert riser 30.

The production riser 2 remains present around the insert riser 30, thus it acts as a carrier pipe that protects the insert riser 30. The insert riser 30 therefore need not be designed to the same design requirements as the production riser 2 because the insert riser 30 will not see the same dynamic forces as the production riser 2. The insert riser 30 can rely on the production riser 2 to provide structural protection against environmental loading and the marine environment, while the insert riser 30 will contain and seal the fluid path.

The desired time after the initial period of production can be selected for any of a number of reasons. For instance, in one embodiment, the desired time can be when there is evidence of significant reservoir souring having occurred in the field. The desired time can be at a time when other fields are tied in to the field. The desired time can be when the production riser 2 has shown signs of wall thinning or similar damage. The desired time can be when flow rate of production fluids from the reservoir has decreased substantially, thus requiring either smaller diameter, or artificial lift, such as gas lift or insertion of an electric submersible pump (ESP). Any event that would trigger replacing the production riser 2 can mark the desired time.

Once the insert riser 30 is installed, the seal at the PLET 8 and/or the insert riser 30 can be pressure tested to ensure no leaks are present in the production riser system.

In certain embodiments, the annulus 38 between the insert riser 30 and the production riser 2 can advantageously be used for a variety of beneficial purposes in addition to changing the riser diameter. For instance, in one embodiment, the annulus 38 can be used to provide gas lift to enhance the flow of production fluids as previously described.

In one embodiment, the annulus 38 can be used to provide a pathway for chemicals to be injected at predetermined points or liquid penetrators 48. Chemicals can be injected for a variety of purposes, including but not limited to hydrate prevention, wax prevention and corrosion inhibition. When larger volumes of chemicals are required, e.g. when continuously injecting methanol or monoethylene glycol (MEG), the chemicals can be introduced into the annulus 38 and the annulus 38 can be flooded with the chemicals. The chemicals can be introduced by tubing 50. The tubing 50 can extend from a source of the chemicals, through a liquid penetrator 48 and into the annulus 38. The tubing 50 can have an open subsea end for delivering the chemicals into the annulus 38 at a subsea e.g., at the PLET 8.

In one embodiment, the annulus 38 itself provides thermal insulation around the insert riser 30.

In one embodiment, the riser base has the capability to establish communication between the production flow path within the insert riser 30 and the annulus 38. In such case, the insert riser 30 is only partially inserted into the production riser 2 so that the seal elements 32 of the insert riser 30 do not actually engage the recessed seal face 14 of the production riser 2. A flow path is thereby provided from the inner surface of the insert riser 30 into the production riser 2 around the distal end of the insert riser 30. A fluid can thus be injected into the insert riser 30 from the floating structure 5. The fluid can be allowed to flow along the flow path to flush the annulus 38 between the insert riser 30 and the production riser 2. In one embodiment, this method can be used to force a desired the fluid in the annulus 38 and another fluid in the insert riser 30 bore. For instance, one of the chemicals described above can be in the annulus 38 and diesel or gas in the bore of the insert riser 30. In one embodiment, this method can be used to change column fluid densities to aid in startup of the well.

In one embodiment, the annulus 38 can be used as part of an active heating system. In one embodiment, the annulus 38 may be used to pump hot water in a total loss system, where the water being pumped through the annulus 38 is used to heat the production fluids within the insert riser 30. The hot water may then be vacated to the sea. In one embodiment, electric heat tracing (not shown) may be attached to the insert riser 30 to heat the production fluids within the insert riser 30, thereby facilitating fluid flow and preventing the formation of hydrates.

In one embodiment, the annulus 38 can be used in a multifunctional pipeline system as disclosed in U.S. Pat. No. 8,950,499, the contents of which are incorporated herein by reference. In embodiments in which during initial engineering it is identified that the internal diameter of the insert riser 30 is too small to allow pigging, the PLET can leverage embodiments disclosed in U.S. Pat. No. 8,950,498, the contents of which are incorporated herein by reference.

Use of the apparatus, systems and methods of the present disclosure can result in significant cost savings. In one nonlimiting, illustrative example, a 20 in diameter subsea catenary riser is installed in 1000-meter-deep water in a "Lazy-S" configuration at vessel and labor cost (mobilization and demobilization) plus material cost per riser length. By using the system of the disclosure, operating expense and capital expense reductions can be realized.

It should be noted that only the components relevant to the disclosure are shown in the figures, and that many other components normally part of a production riser system are not shown for simplicity.

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

From the above description, those skilled in the art will perceive improvements, changes and modifications, which are intended to be covered by the appended claims.

What is claimed is:

1. An apparatus for facilitating a change in diameter of a riser for transporting production fluids from a subsea well to a production facility on a floating structure after an initial period of production, comprising:

a. a production riser having a topsides end for attaching to a riser hanger assembly on the floating structure, a subsea end for supporting on a pipeline end termination structure located on a seabed and attaching to a subsea pipeline, an outer production riser surface and an inner production riser surface, wherein the inner production riser surface comprises a polished recessed seal face proximate the subsea end for receiving one or more seal elements and a recessed lock groove proximate the polished recessed seal face;

b. a protective sleeve proximate the subsea end for covering the polished recessed seal face, wherein the protective sleeve has an outer sleeve surface for partially engaging the inner production riser surface and an inner sleeve surface comprising a groove therein for receiving a sleeve removal tool;

c. a temporary retaining ring in the recessed lock groove in the inner production riser surface for holding the protective sleeve in place during the initial period of production; and d. an insert riser having an insert riser length, an outer insert riser surface and an inner insert riser surface, for insertion into the production riser following the initial period of production, wherein the insert riser comprises one or more seal elements around the outer insert riser surface for engaging the polished recessed face of the production riser and a locking ring around the outer insert riser surface for fitting into the recessed lock groove of the production riser.

2. The apparatus of claim 1 further comprising a temporary seal between the polished recessed face and the protective sleeve for protecting the polished recessed seal face during the initial period of production.

3. The apparatus of claim 1 further comprising a plurality of centralizers along the insert riser length for centering the insert riser within the production riser.

4. The apparatus of claim 3 wherein, when the insert riser is inserted into the production riser, an annulus between the outer insert riser surface and the inner production riser surface is formed.

5. The apparatus of claim 4 further comprising a seal assembly between the topsides end of the production riser and the riser hanger assembly for isolating the annulus at the topsides end of the production riser.

6. The apparatus of claim 4 further comprising a spool piece having an opening therein located between the topsides end of the production riser and the riser hanger assembly wherein the opening provides an access point for the injection of liquids or gas into the annulus.

7. The apparatus of claim 6 wherein the spool piece further comprises an injection check valve for injecting the liquids or gas into the annulus between the outer insert riser surface and the inner production riser surface.

8. The apparatus of claim 7 further comprising at least one tubing extending into the annulus having a topside end connected to the opening and a subsea end open to the annulus for introducing liquids into the annulus at a subsea location.

9. The apparatus of claim 4 wherein the insert riser further comprises a side pocket mandrel comprising gas lift valves for injecting gas into the insert riser.

10. A production riser system for facilitating a change in diameter of a riser for transporting production fluids from a subsea well to a production facility on a floating structure after an initial period of production, the system comprising:

a. a pipeline end termination structure located on a seabed a distance along the seabed from the floating structure; and b. the apparatus of claim 1 wherein the subsea end of the production riser is mounted on the pipeline end termination structure and the topsides end of the production riser is attached to the riser hanger assembly on the floating structure.

11. The production riser system of claim 10 further comprising a temporary seal between the polished recessed face and the protective sleeve of the apparatus of claim 1 for protecting the polished recessed seal face during the initial period of production.

12. The production riser system of claim 10 further comprising a plurality of centralizers along the insert riser length for centering the insert riser within the production riser of the apparatus of claim 1.

13. The production riser system of claim 10 wherein when the insert riser is inserted into the production riser, an annulus is formed between the outer insert riser surface and the inner production riser surface of the apparatus of claim 1.

14. The production riser system of claim 13 further comprising a seal assembly between the topsides end of the production riser and the riser hanger assembly for isolating the annulus at the topsides end of the production riser.

15. A method for changing diameter of a riser for transporting production fluids from a subsea well to a production facility on a floating structure after an initial period of production, the method comprising:

a. providing the production riser system of claim 10;

b. at a desired time after the initial period of production, inserting intervention coiled tubing into the production riser of the apparatus of claim 1 from the floating structure wherein the tubing comprises a sleeve removal tool at a distal end thereof;

c. engaging the groove of the inner sleeve surface of the protective sleeve with the sleeve removal tool; and d. pulling the intervention coiled tubing to the floating structure thereby removing the protective sleeve and the temporary retaining ring from the production riser and exposing the polished recessed seal face.

16. The method of claim 15 further comprising inserting from the floating structure the insert riser wherein the insert riser has a distal end, an insert riser length, an outer insert riser surface and an inner insert riser surface into the production riser, and fully inserting the insert riser such that the seal elements engage the polished recessed seal face and the locking ring fits into the recessed lock groove.

17. The method of claim 15 further comprising partially inserting from the floating structure the insert riser wherein the insert riser has a distal end, an insert riser length, an outer insert riser surface and an inner insert riser surface into the production riser, such that the seal elements do not engage the polished recessed seal face and the retaining ring does not fit into the recessed lock groove and a flow path is provided from the inner insert riser surface into the production riser around the distal end of the insert riser; and injecting a fluid into the insert riser from the floating structure and allowing the fluid to flow along the flow path, thereby flushing an annulus between the outer insert riser surface and the inner production riser surface.

* * * * *